United States Patent [19]

Amemiya et al.

[11] Patent Number: 4,914,737

[45] Date of Patent: Apr. 3, 1990

[54] IMAGE FORMING APPARATUS

[75] Inventors: Koji Amemiya; Takeshi Menjo, both of Tokyo; Takashi Hasegawa, Warabi; Hiroshi Satomura, Hatogaya, all of Japan

[73] Assignee: Canon Kabushiki Kaisha, Tokyo, Japan

[21] Appl. No.: 390,425

[22] Filed: Aug. 4, 1989

Related U.S. Application Data

[63] Continuation of Ser. No. 216,169, Jul. 7, 1988, abandoned.

[30] Foreign Application Priority Data

Jul. 9, 1987 [JP] Japan ..... 62-171654

[51] Int. Cl.[4] ..... G03G 15/14; G03G 15/16

[52] U.S. Cl. ..... 355/276; 355/268; 355/274; 355/326; 118/645

[58] Field of Search ..... 355/276, 268, 273, 274, 355/326; 118/645, 653; 430/120, 357

[56] References Cited

U.S. PATENT DOCUMENTS

| | | | |
|---|---|---|---|
| 4,023,894 | 3/1977 | Goel | 355/3 R |
| 4,401,383 | 8/1983 | Suzuki et al. | 355/3 TR |
| 4,402,591 | 9/1983 | Nakahata | 355/3 TR |
| 4,482,240 | 11/1984 | Kuge et al. | 355/3 TR |
| 4,531,828 | 7/1985 | Hoshino | 355/3 SH |
| 4,669,861 | 6/1987 | Nukushina et al. | 355/3 TR X |
| 4,676,627 | 6/1987 | Ohno | 355/14 CH |
| 4,688,927 | 8/1987 | Oda et al. | 355/3 TR |

FOREIGN PATENT DOCUMENTS

| | | |
|---|---|---|
| 3408336 | 9/1984 | Fed. Rep. of Germany . |
| 54-65547 | 7/1979 | Japan . |
| 54-70051 | 8/1979 | Japan . |
| 55-28074 | 2/1980 | Japan . |
| 55-38502 | 5/1980 | Japan . |
| 56-99356 | 10/1981 | Japan . |
| 59-50460 | 7/1984 | Japan . |
| 61-73976 | 8/1986 | Japan . |

OTHER PUBLICATIONS

Copy of European Search Report dated Jun. 22, 1989 and Annex to Search Report.

*Primary Examiner*—A. C. Prescott

*Attorney, Agent, or Firm*—Fitzpatrick, Cella, Harper & Scinto

[57] ABSTRACT

An image forming apparatus includes a movable image bearing means, an image forming device for forming an image on the image bearing member, an image receiving material bearing member for carrying and conveying an image receiving material to an image transfer station where the image formed by the image forming device is transferred from the image bearing member to the image receiving material, an image transfer device disposed at the transfer station in opposition to the image bearing device, a discharger, disposed downstream of the image transfer device with respect to the movement direction of the image receiving material and in opposition to the image receiving material carrying member, and operative when a trailing edge of the image receiving material is substantially immediately before a transfer zone by the image transfer device or when it is in the transfer zone, during the period when the image receiving material is conveyed by the image receiving material carrying member.

20 Claims, 6 Drawing Sheets

IMAGE FORMING APPARATUS

This application is a continuation of application Ser. No. 216,169, filed July 7, 1988, now abandoned.

FIELD OF THE INVENTION AND RELATED ART

The present invention relates to an image forming apparatus such as an electrophotographic apparatus and an electrostatic recording apparatus, and more particularly to a color image forming apparatus such as a multi-color electrophotographic copying apparatus provided with plural developing devices, a multi-color recording apparatus constituting an output for a facsimile machine, a computer or the like, and various color printers.

Various proposals have been made with respect to a multi-color electrophotographic machines.

Referring to FIG. 4, there is shown a typical multi-color electrophotographic apparatus provided with a so-called rotary type developing device. The multi-color electrophotographic apparatus shown in FIG. 4 includes an image bearing member, that is, a photosensitive drum 1 supported for rotation in the direction indicated by an arrow. Around the photosensitive drum 1, there are disposed various image forming means. The image forming means may be any of known types, and in this example, they includes a charger 2 for uniformly charging the photosensitive drum 1, exposure means 3 for projecting onto the photosensitive drum 1 the light information in the form of or corresponding to a color separated light image to form an electrostatic latent image on the photosensitive drum 1, for example, a laser beam scanning device, and a rotary type developing device 4 for visualizing the electrostatic latent image thus formed on the photosensitive drum 1.

The rotary type developing device 4 includes four developing units 4Y, 4M, 4C and 4BK containing a yellow developer, a magenta developer, a cyan developer and a black developer, respectively, and a generally cylindrical casing 40 rotatably supported and supporting the four developing units 4Y, 4M, 4C and 4BK. The rotary type developing device 4 presents, by the rotation of the casing 40, a desired developing device to a developing position where the developing unit is opposed to an outer periphery of the photosensitive drum 1 to develop the electrostatic latent image on the photosensitive drum 1. By one full rotation of the casing 40, four color developing operations are performed.

The developed or visualized image, that is, the toner image on the photosensitive drum 1 is transferred at a transfer station onto a transfer material P conveyed on a transfer material carrying means 5. In this example, the transfer material carrying means 5 is in the form of a transfer drum rotatably supported. As will be understood from FIGS. 4 and 5, a cylinder 5*a* has an opening indicated by broken lines, a transfer charger 5*b* provided in the cylinder 5*a* and a gripper 5*c* for gripping a leading edge of the transfer material supplied from an unshown transfer material supplying device.

An inside discharger 5*d* and an outside discharger 5*e* which constitute a discharging means are disposed inside and outside the transfer drum 5, respectively. The discharging means is disposed downstream of the transfer charger 5*b* with respect to the movement direction of the transfer drum 5. A dielectric material sheet 501 for supporting the transfer material is stretched to cover the opening of the cylinder 5*a*. The sheet 501 is usually made of, for example, polyethyelen terephthalate resin film or polyvinylidene fluoride resin film or the like.

A full-color image forming process of the multi-color electrophotographic apparatus will be described briefly. First, the charger 2 and the image exposure means 3 are operated so as to form a blue color-separated electrostatic latent image on the photosensitive drum 1, which is then developed with the yellow developer contained in the developing unit 4Y. On the other hand, the transfer material advanced to the transfer drum 5 is gripped by the gripper 5*c*, and by the rotation of the transfer drum 5 the transfer material is contacted to the toner image formed on the outer periphery of the photosensitive drum 1. The toner image is transferred onto the transfer material by the operation of the transfer charger 5*b*, and simultaneously, the transfer material is electrostatically attracted to the dielectric sheet 501.

The image forming and image transfer operations are repeated for the magenta, cyan and black colors. After completion of the superimposed image transfer of the four color visualized images onto the transfer material P, the transfer material P is electrically discharged by the inside discharger 5*d* and the outside discharger 5*e*, and then is separated from the transfer drum 5 by a separating means 8. Subsequently, the transfer material P is discharged through a heating roller type image fixing device 6 to the outside of the apparatus. On the other hand, the toner remaining on the photosensitive drum 1 is removed by a cleaner 7, so that the photosensitive drum 1 is prepared for the next image forming operation.

Although the multi-color electrophotographic apparatus having this structure operates in good order, the inventors' investigations and experiments have revealed that there arises a problem when a volume resistivity of the used transfer material is decreased due to increased humidity, or when the transfer material per se has a small volume resistivity. This will be described in detail.

Referring to FIG. 6, the discharging means includes an inside corona discharger 5*d* in the form of an AC corona discharger to which a DC bias voltage can be applied and an outside corona discharger 5*e* in the form of an AC corona discharger.

Referring to FIG. 8 illustrating sequential operations of various parts of the image forming apparatus, the inside discharger 5*d* and the outside discharger 5*e* are operated only during a pre-rotation (third and fourth rotations of the photosensitive drum 1) prior to the start of the image forming process operation of the image forming apparatus and during the period (10th, 11th and 12th rotations of the photosensitive drum) from the start of the image forming process operation for the last color-separated image to the termination of the image forming process by the transfer material being separated from the transfer drum 5. FIG. 8 shows the case where an A4 (JIS) size sheet is carried on the transfer drum.

Referring to FIG. 6, there is shown an electric charge adjacent a trailing edge of the transfer material when the transfer material P on the transfer drum 5, having received only one color toner, image, is kept supported on the transfer drum to receive another color toner image and is rotated together with the photosensitive drum 5. As described in conjunction with FIG. 8, at the stage shown in FIG. 6, the inside discharger 5*d* and the outside discharger 5*e* are not operated (5th–9th rotations of the photosensitive drum of FIG. 8), and the transfer means, that is, the transfer charger 5*b* is still operated. The polarity of the transfer voltage supplied to the transfer charger 5b is positive, for example, if the latent image is formed by negative charge, which is developed by negatively charged toner for the reversal development.

The inventors' investigations and experiments have revealed that when polyvinylidene fluoride resin film is used as the dielectric member sheet 501, and when the transfer material P is paper, the positive charge from the transfer charger is injected into the transfer sheet through the dielectric sheet (the volume resistivity of the transfer paper is $10^9$ (high humidity)–$10^{12}$ (low humidity) ohm.cm), particular humidity conditions; and as a result, the positive charge is accumulated adjacent the surface region Pa adjacent the trailing edge of the transfer sheet.

Further, it has been revealed that the positive charge accumulated there produces a strong electric field between the charge on the photosensitive drum surface; that as shown in FIG. 7, when the trailing edge Pa of the transfer sheet is separated from the photosensitive drum 1, a separation discharge occurs; that the resultant negative charge in the air is attracted by the positive charge on the transfer sheet P and is moved onto the transfer sheet; and that the positive charge in the air is moved to the photosensitive drum 1 having the negative charge, and damages the photosensitive drum 1 by giving a memory effect. The memory effect results in that the amount of charge provided on the photosensitive drum 1 by the charger 2 is decreased in the form of a stripe or stripes extending along the longitudinal direction of the photosensitive drum 1, thus deteriorating the uniform charging of the photosensitive drum 1, by which a partial non-image portion appears. That is, this phenomenon appears as an improper image adjacent the trailing edge of the transfer sheet P.

SUMMARY OF THE INVENTION

Accordingly, it is a principal object of the present invention to provide an image forming apparatus wherein a separation discharge between an image bearing member and a transfer material attributable to the accumulation of the electric charge adjacent the trailing edge of the transfer material, is prevented; and the image bearing member can be uniformly charged, so that non-image portion is not produced with high image quality.

It is another object of the present invention to provide a multi-color image forming apparatus by which a high quality multi-color image can be provided without color misregistration or a non-transferred image portion.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The detailed description of the preferred embodiments will be made in conjunction with the accompanying drawings.

Figure 4:
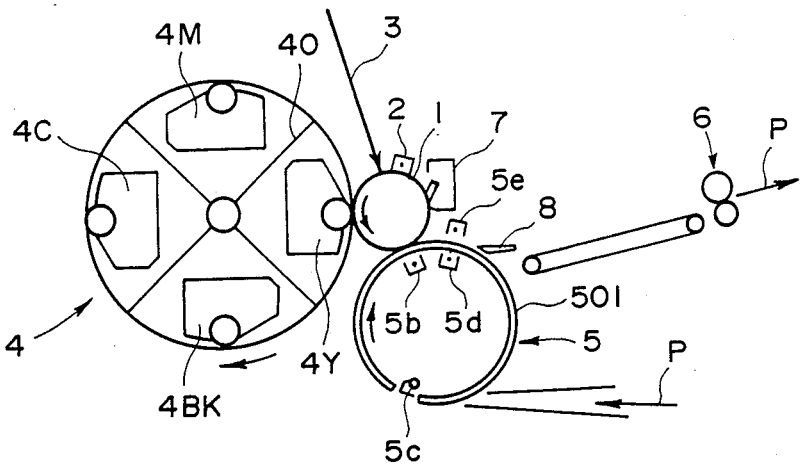
FIG. 4 is a schematic sectional view of a multi-color electrophotographic apparatus to which the present invention is applicable.
Figure 5:
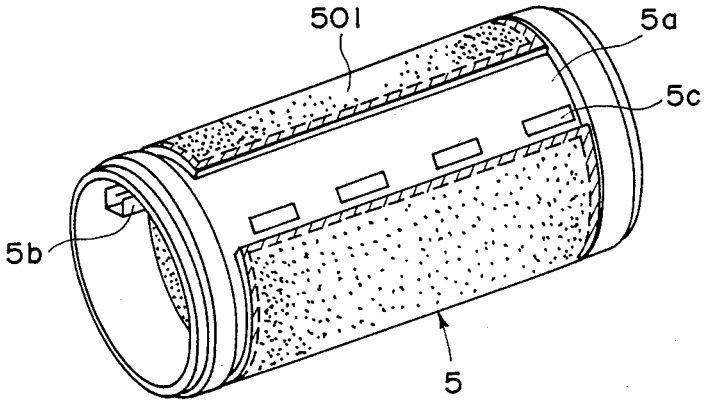
FIG. 5 is a perspective view of an example of a transfer material conveying means usable with the image forming apparatus shown in FIG. 4.

The feature of the present invention is properly applicable to a multi-color electrophotographic apparatus having a rotary type developing device shown in FIGS. 4 and 5. Therefore, the present invention in this embodiment will be described as being employed in the multi-color electrophotographic apparatus shown in FIGS. 4 and 5. Therefore, the general descriptions of the structures and operations are omitted for the sake of simplicity. The diametr of the photosensitive drum 1 functioning as an image bearing member has a diameter of 80 mm, for example, whereas the transfer drum 5 has a diameter of 160 mm which is a double of the diameter of the photosensitive drum 1.

The photosensitive drum 1 is rotated in the direction indicated by an arrow at a peripheral speed of 160 mm/sec, and the surface of the photosensitive drum 1 is charged by the charger 2 to −500 −−800 V. In this embodiment, the photosensitive drum 1 is an organic photoconductor layer. After the charging by the charger 2, the photosensitive drum 1 is exposed to light information in accordance with color information by a laser beam scanning means (not shown) so that an electrostatic latent image is formed in accordance with the color information. Therefore, the image exposure in this embodiment is an image exposure type wherein the image portion is a light portion.

Each of the developing units 4Y, 4M, 4C and 4BK of the rotary type developing device 4 contain negatively charged respective color toners, and the developing units visualize the electrostatic latent images sequentially formed on the photosensitive drum, by a reverse development.

The transfer means in this embodiment is of the same structure as shown in FIGS. 4 and 5. More particularly, the transfer means comprises a rotatably supported transfer drum 5 which includes a cylinder 5a having a stretched dielectric material sheet 501 functioning as a transfer material carrying sheet, a transfer charger 5b disposed inside the transfer drum 5 and a gripper 5c for gripping a leading edge of the transfer material P fed from an unshown sheet feeding device. An inside discharger 5d and an outside discharger 5e which constitute a discharging means are disposed inside and outside of the transfer drum 5..

The dielectric material sheet 501 includes a polyvinylidene fluoride resin film having a thickness of 100–175 microns and a volume resistivity of $10^{13}$ ohm.cm.

In this structure, the transfer sheet P (the image receiving material) whose leading edge is gripped by the gripper 5c is conveyed to a transfer station where the transfer charger 5b is opposed to the photosensitive drum 1 on the dielectric sheet 501. At the transfer station, the visualized image on the photosensitive drum 1 is transferred onto the transfer material P by the transfer charger 5b.

Figure 1:
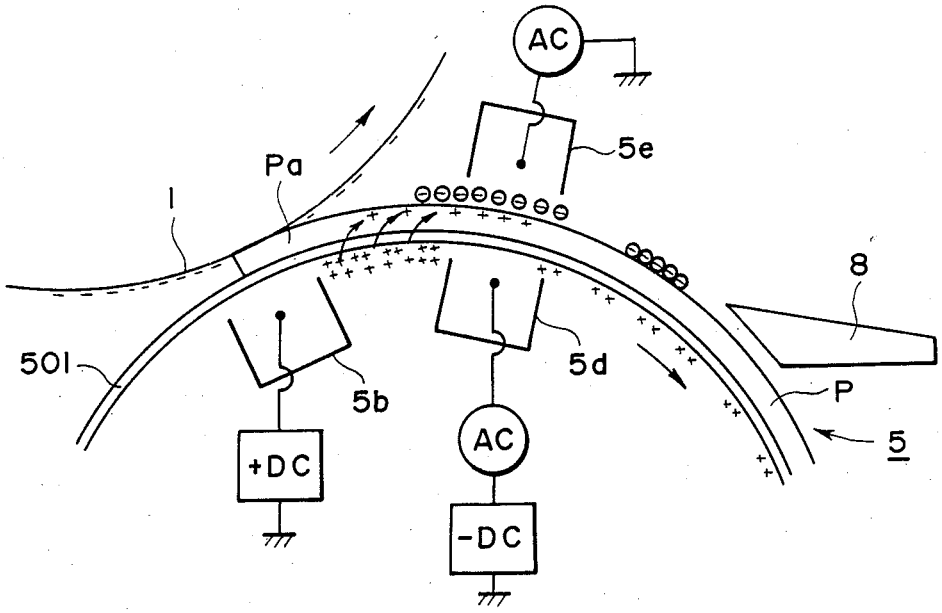
FIG. 1 is a partial and enlarged view of transfer means and discharging means, showing the relation of them with a transfer material in an image forming apparatus according to the present invention.

Referring now to FIG. 1, the behavior of the electric charge will be described. The transfer charger 5b is in the form of a corona discharger, and is supplied with +6 KV−+9 KV voltage so as to provide the transfer current of +100−+500 microamperes. The polarity of the transfer voltage is opposite to that of the toner. Immediately downstream of the transfer charger 5b, a pair of discharging means are disposed opposite to each other with the dielectric sheet 501 therebetween. The pair of the discharging means includes an inside corona discharger 5d in the form of an AC discharger (peak-to-peak voltage of 12 KVpp, 800 microampere) to which a DC bias (−4.0 KV−−5.0 KV, −10−−60 microampare) is applicable, and an AC corona discharger 5e (peak-to-peak voltage of 8 KVpp, and 600 microampare), wherein the phase of the AC component of the outside discharger 5e and that of the inside discharger 5d are controlled so as to be opposite to each other.

Figure 2:
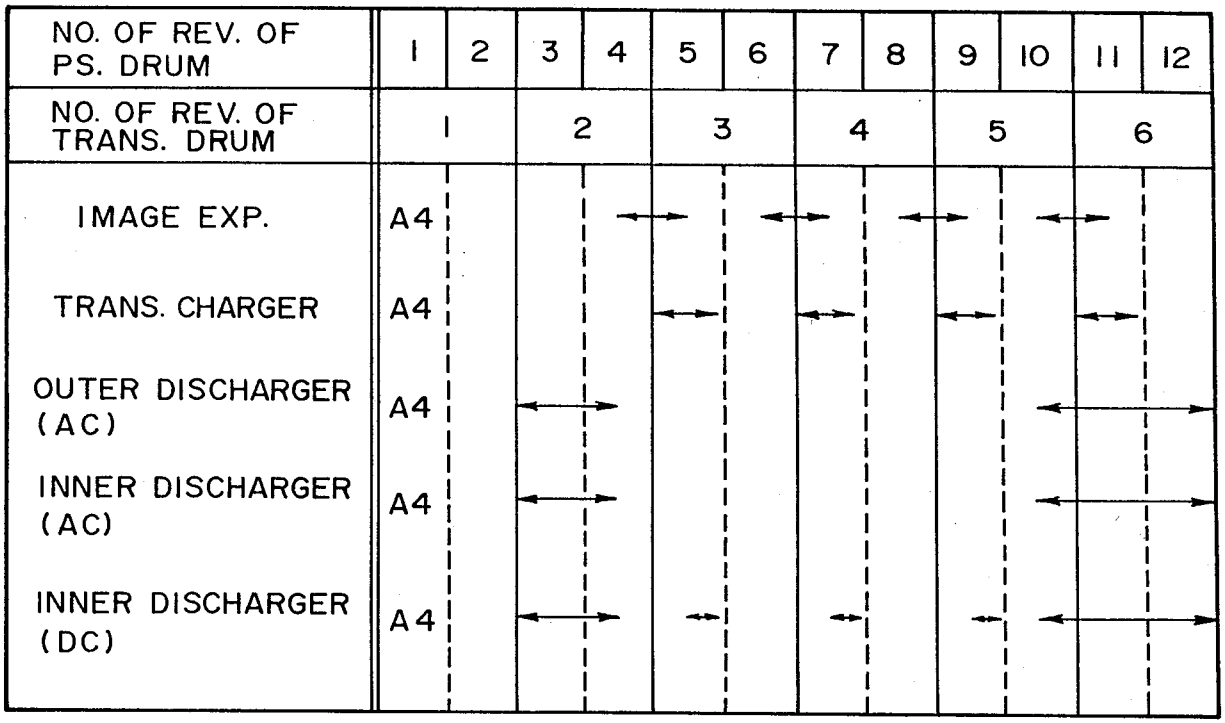
FIG. 2 is a timing chart illustrating sequential operation of the transfer means and the discharging means with respect to the number of rotations of the photosensitive drum and the transfer drum in the image forming apparatus.

In this structure, the discharging means, i.e., the inside discharger 5d and the outside discharger 5e are operated similarly to the case of a conventional image forming apparatus as shown in FIG. 2 when an A4 size transfer material is carried on the transfer drum. That is, it is operated during the pre-rotation (third and fourth photosensitive drum rotations) prior to the start of the image forming process in the image forming apparatus and during the period after the start of the image forming process operation for the last color separated image to the end of the image forming process by the transfer material being separated from the transfer drum (10th and 12th rotations of the photosensitive drum). According to this invention, to the inside discharger 5d of the discharging means, a DC component (−4.0−−5.0 KV, −10−−60 microampere) is applied immediately before the transfer voltage is stopped at each of the transferring steps. The DC component is applied thereto when the trailing edge of the transfer material is opposed to immediately before the transfer charger 5b or when the trailing edge of the transfer material P is opposed to the image transfer zone by the transfer charger 5b. In either case, the DC component is applied when the trailing edge portion Pa of the transfer material P is under the influence of the transfer charger.

As to the times when the transfer charger is not operated, they are synchronized with the energization of the transfer charger in this embodiment, but this is not limiting, and it will suffice if the discharging means is stopped before the leading edge of the transfer material comes to the transfer position.

In this embodiment, the position where the discharging means operates is as follows. The discharging wire of the transfer charger 5b is substantially on a line connecting the center of the photosensitive drum having a diameter of 80 mm and the center of the transfer drum 5 having a diameter of 160 mm. The discharging wire of the inside discharger 5d is disposed approximately 23 degrees away, from the discharging wire of the transfer charger 5b in the downstream direction with respect to the movement direction of the transfer drum. The discharging wires of the transfer charger 5b and the inside discharger 5d are disposed approximately several tens mm away from the surface of the dielectric material sheet 501. With such a structure, "immediately before the transfer charger or transfer zone" in this embodiment means approximately 25 mm away from the contact point between the photosensitive drum 1 and the transfer drum 5 in the upstream direction with respect to the movement direction of the transfer drum 5 on the peripheral surface of the photosensitive drum 5. In this embodiment, the transfer zone by the transfer means is a zone which is influenced by the transfer corona discharge confined by a shield member enclosing a discharging wire of the transfer charger 5b.

It may be properly determined by one skilled in the art depending on the resistivity of the transfer material whether the discharging means is operated when the trailing edge of the transfer material is opposed immediately before the transfer charger or the transfer zone or whether the discharging means is operated when the trailing edge of the transfer material enters the transfer zone.

The operation of the discharging means is effected each time a transfer material P passes by the transfer charger 5b to receive the toner image from the photosensitive drum 1 in which time the positive charge is applied on the transfer material (transfer charge), so that the transfer material having received the toner image is electrically discharged at its trailing edge portion Pa. In the image forming apparatus according to this embodiment wherein a full-color image is formed by four color image forming process, the trailing edge portion of the transfer material is electrically discharged upon the respective terminations of the transfer operations for the yellow image, magenta image, and the cyan image (fifth, 7th and 9th rotations of the photosensitive drum).

After the image transfer step (the 11th rotation of the photosensitive drum) for the last color, that is, black, the transfer material P is separated from the transfer drum 5. For the separation, the transfer material P is electrically discharged on its entire surface.

In consideration of this, the inside discharger 5d and the outside discharger 5e are operated simultaneously a little earlier than the operation of the transfer charger 5b. At this time, the inside discharger 5d is supplied with a DC component, and in addition, the inside and outside dischargers 5d and 5e are supplied with AC components (10th–12th rotations of the photosensitive drum).

In this manner, the discharging means are controlled.

Figure 6:
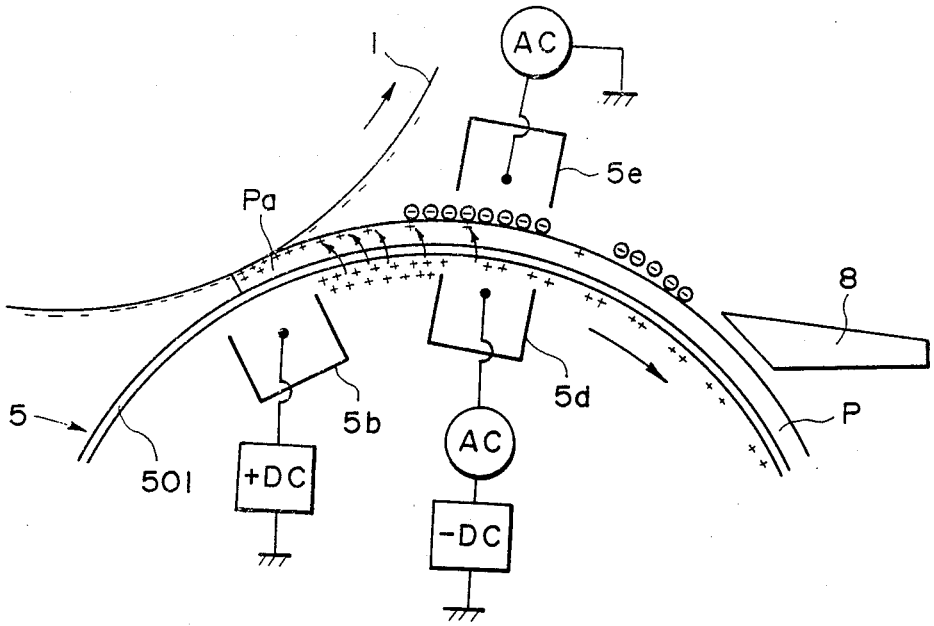
FIGS. 6 and 7 are partial and enlarged views illustrating a problem with prior art.
Figure 7:
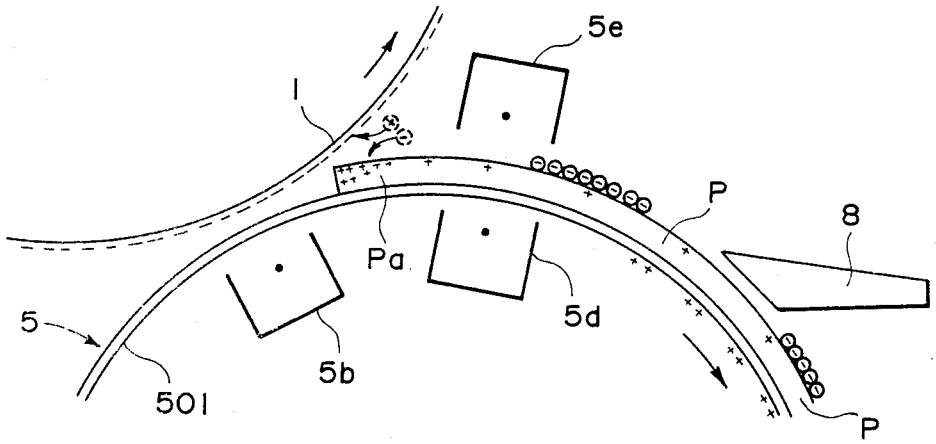
Figure 8:
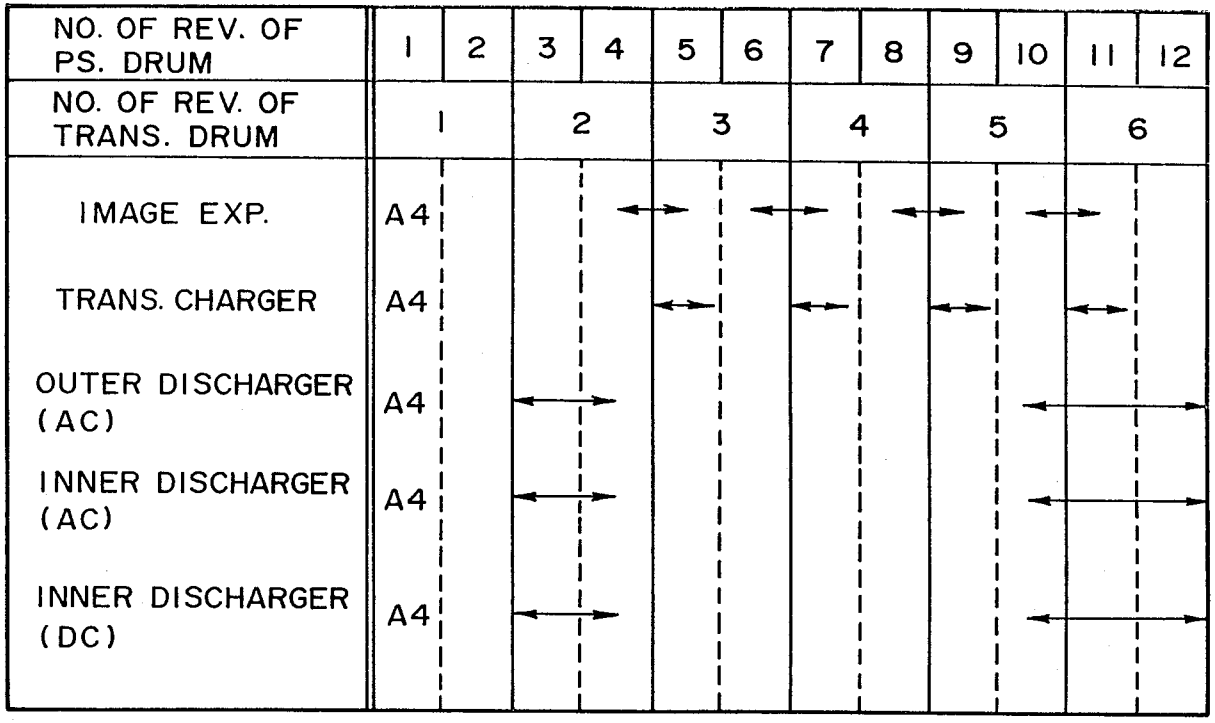
FIG. 8 is a timing chart illustrating sequential operations of the transfer means and the discharging means with respect to the number of rotations of the photosensitive drum and the transfer drum in a conventional forming apparatus.

According to this embodiment, before the trailing edge Pa of the transfer material P having received the toner image is separated from the photosensitive drum 1, the inside discharger 5d acting from the dielectric sheet 501 side applies negative charge onto the dielectric sheet 501, and at this time, a part of the negative charge is injected into the transfer material P. The negative electric charge on the dielectric sheet 501 provided by the transfer charger 5b and the negative charge injected into the transfer sheet P through the dielectric sheet 501, attract toward the negative charge on the dielectric sheet the positive charge accumulated adjacent the surface region adjacent the trailing edge portion Pa of the transfer material P. Also, the electric charge injected into the transfer sheet P through the dielectric sheet 501 is combined with the positive charge to dissipate a large amount of the positive charge. Therefore, according to this invention, the positive charge accumulated in the surface region of the trailing edge portion Pa of the transfer sheet according to the prior art, is almost eliminated, by which no strong electric field is produced between the surface region of the trailing edge of the transfer material and the surface of the photosensitive drum. Therefore, as shown in FIG. 6, when the trailing edge portion Pa of the transfer material P is separated from the photosensitive drum 1, the separation discharge is prevented, and therefore, the memory effect due to the positive charge in the air moving onto the photosensitive drum 1 with the negative charge can be prevented. In addition, the obstruction to the charging by the charger 2 to the photosensitive drum 1 is prevented, and therefore, the image is properly transferred onto the transfer material.

Figure 3:
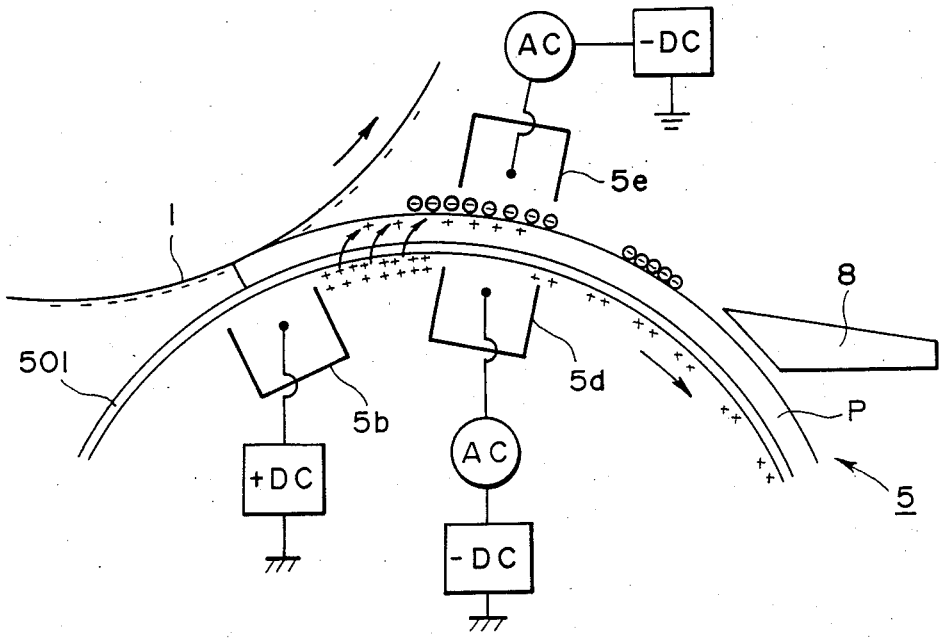
FIG. 3 is a partial and enlarged sectional view of the transfer means and the discharging means illustrating the relationship of them with a transfer material in an image forming apparatus according to another embodiment of the present invention.

In the embodiments described in the foregoing, the discharging for the trailing edge portion of the transfer material is performed by applying only a DC component to the inside discharger 5*d*, but the present invention is not limited to this. The following alternatives are possible:

(1) Only an AC component is applied to the inside discharger 5*d*:

(2) DC and AC components are simultaneously applied to the inside discharger 5*d*:

(3) The outside discharger 5*e* is in the form, as shown in FIG. 3 for example, of an AC discharger to which a DC bias having a polarity which is the same as that of the toner can be applied, and the outside discharger 5*e* is supplied only with a DC component having a polarity opposite to that of the transfer charger 5*b*:

(4) The outside discharger 5*e* has the structure as shown in FIG. 3, and the outside discharger 5*e* is supplied with an AC component and a DC component which has a polarity opposite to that of the transfer charger 5*b*:

(5) The discharging means has a structure shown in FIG. 1 or FIG. 3, and both of the inside discharger 5*d* and the outside discharger 5*e* are operated. With those structures, it is possible to properly discharge the electric charge accumulated adjacent the trailing edge of the transfer material. Here, operation timing of the discharging means is similar to those of the inside discharger 5*d* described in conjunction with FIG. 1. The operation of the discharging means is started when the trailing edge side of the transfer material is still in the transfer zone, and therefore, the discharging current by the discharging means is preferably determined so as not to extremely influence the transfer electric field in the transfer zone.

Figure 9:
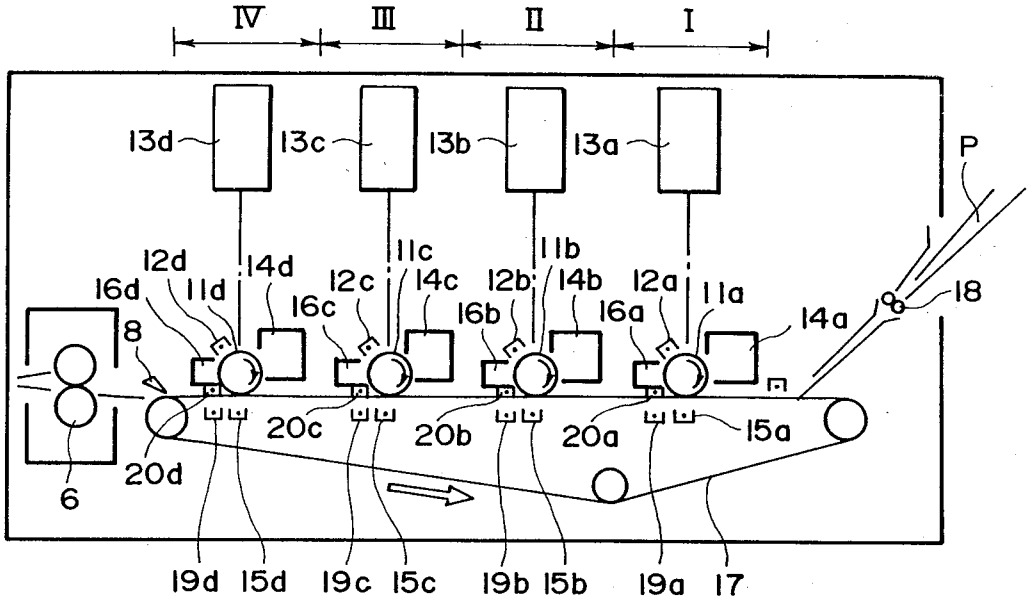
FIG. 9 is a schematic sectional view of another example of a multi-color electrophotographic apparatus to which the present invention is applicable.

The applicability of the present invention is not limited to the multi-color electrophotographic apparatus comprising only one image bearing member as described in the foregoing. Referring to FIG. 9, there is shown another type multi-color electrophotographic apparatus provided with four image forming stations I–IV. In this embodiment, each of the image forming stations I–IV includes a photosensitive drum (image bearing member) 11*a*, 11*b*, 11*c* or 11*d*. Around each of the photosensitive drums, there are provided a charger 12*a*, 12*b*, 12*c* or 12*d*, exposure means 13*a*, 13*b*, 13*c* or 13*d*, a developing device for yellow, magenta, cyan or black color 14*a*, 14*b*, 14*c* or 14*d*, a transfer charger 15*a*, 15*b*, 15*c* or 15*d* and a cleaner 16*a*, 16*b*, 16*c* or 16*d*. A conveying means made of a dielectric material 17 in the form of an endless belt is disposed below each of the photosensitive drums in a form to penetrate the image forming stations. The transfer material P supplied by a feeding roller 18 is conveyed through the transfer stations where the respective transfer chargers 15*a*, 15*b*, 15*c* and 15*d* are disposed. The image forming apparatus includes image fixing means 6 and separating means 8.

In this embodiment, discharging means is disposed downstream of each of the transfer chargers 15*a*–15*d* and adjacent thereto so as to electrically discharge the trailing edge portion of the transfer material having received the toner image. The discharging means includes an inside discharger 19*a*, 19*b*, 19*c* or 19*d* and an outside discharger 20*a*, 20*b*, 20*c* or 20*d*. The corresponding inside dischargers and outside dischargers are opposed to the respective ones of each other with the conveying belt 17 interposed therebetween.

The voltage applied to the dischargers and the operation timing for the purpose of electrically discharging the trailing edge portion of the transfer material are substantially the same as in the foregoing embodiment. In this embodiment, the improper image transfer can be prevented, not to the same transfer material, but to the next transfer material.

In all of the embodiments described in the foregoing description has been made with respect to the trouble caused by the electric charge accumulated adjacent the ling edge portion of the transfer material when the ambient, conditions under which the apparatus is operated include high humid conditions, and the resistivity of the transfer material is thereby decreased. However, the same problem arises when the resistivity of the transfer material itself is originally small, irrespective of the ambient conditions. In view of this, the present invention is more effective if the operation timing of the discharging means is controlled in the manner described above depending on the materials of the transfer sheet. When the volume resistivity of the transfer material is not more than $10^{10}$ ohm.cm, it is preferable that the discharging means is operated irrespective of the ambient conditions.

In the foregoing embodiments, the discharging means includes a couple of dischargers disposed opposed to each other as an exemplary discharging means, only one discharger is employed only for the purpose of electrically discharging the trailing edge portion of the transfer material.

As described in the foregoing, according to the present invention, the occurrence of the separation discharge between the transfer material and the image bearing member attributable to the accumulation of the electric charge adjacent to the trailing edge portion of the transfer material, is prevented, so as to make it possible to uniformly charge the latent image bearing member, and therefore, a high quality image can be provided without non-transfer portion of the image. When the present invention is applied to a multi-color forming apparatus, a high quality multi-color image can be particularly provided without color misregistration or non-image transfer portion.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:
movable image bearing means;
image forming means for forming an image on said image bearing means;
image receiving material carrying means for carrying and conveying an image receiving material to an image transfer station where the image formed by said image forming means is transferred from said image bearing means to the image receiving material;
image transfer means disposed at the transfer station in opposition to said image bearing means;
discharging means, disposed downstream of said image transfer means with respect to the movement direction of the image receiving material and in opposition to said image receiving material carrying means, and operative when a trailing edge of the image receiving material is substantially immediately before a transfer zone provided by said image transfer means or when it is in the transfer zone, during the period when the image receiving material is conveyed by said image receiving material carrying means.

2. An apparatus according to claim 1, wherein said image receiving material carrying means includes a dielectric member for carrying the image receiving material.

3. An apparatus according to claim 2, wherein said discharging means is disposed, at the same side of the dielectric member of said image receiving material carrying means as, or the opposite side from, said image transfer means.

4. An apparatus according to claim 3, wherein said discharging means includes a couple of discharging means opposed to each other with the dielectric member of said image receiving material carrying means interposed therebetween.

5. An apparatus according to claim 1, wherein said discharging means is disposed upstream of a position where the image receiving material is separated from said image receiving material carrying means, with respect to the movement direction of the image receiving material.

6. An apparatus according to claim 1 or 2, wherein said image receiving material carrying means is movable along an endless path.

7. An apparatus according to claim 6, wherein said image receiving material carrying means supplies, a plurality of times, the same image receiving material to the transfer station, by which a plurality of image transfer operations are performed on the same image receiving material, wherein said discharging means is operated at said timing for each of the transfer operations except for a last image transfer operation on the same image receiving material.

8. An apparatus according to claim 7, wherein only one image bearing means and only one image receiving material carrying means is provided, and wherein only one image transfer station is provided.

9. An apparatus according to claim 8, wherein said image bearing means and said image receiving material carrying means are in the form of drums.

10. An apparatus according to claim 9, wherein said image bearing means has a diameter smaller than that of said image receiving material carrying means.

11. An apparatus according to claim 1, wherein said image bearing means includes a plurality of image bearing members, and a corresponding number of said image forming means are provided for the respective image bearing members, wherein only one image receiving material carrying means is provided, and the corresponding number of said transfer stations are provided corresponding to the respective image bearing members, and wherein said discharging means is disposed downstream of each of said transfer stations.

12. An apparatus according to claim 11, wherein said image bearing means is in the form of a drum, and wherein said image receiving material carrying means is in the form of a belt.

13. An apparatus according to claim 7, wherein the plural image transfer operations transfer different color images onto the same image receiving material superimposedly, so that a multi-color image is formed on the image receiving material.

14. An apparatus according to claim 1, wherein said transfer means and said discharging means each comprises a corona discharging means.

15. An apparatus according to claim 1, wherein said image forming means includes a latent image forming means for forming an electrostatic latent image on said image bearing means and developing means for developing the electrostatic latent image.

16. An apparatus according to claim 15, wherein a polarity of an electrostatic latent image formed by said latent image forming means is opposite to that of the charging polarity of said image transfer means.

17. An apparatus according to claim 16, wherein said developing means contains a developer electrically charged to a polarity which is the same as that of the electrostatic latent image to reverse-develop the electrostatic laten image.

18. An apparatus according to claim 17, wherein said image bearing means includes a photosensitive member, and said latent image forming mean includes charging means for uniformly charging the photosensitive member and means for applying light information in accordance with image information, and wherein a charging polarity of said charging means is the same as the charge polarity of the developer.

19. An apparatus according to claim 18, wherein said photosensitive member is an organic photoconductor.

20. An apparatus according to claim 14, wherein a polarity of a voltage applied to the discharging means is opposite to a polarity of a voltage applied to said image transfer means.

* * * * *

UNITED STATES PATENT AND TRADEMARK OFFICE

CERTIFICATE OF CORRECTION

PATENT NO. : 4,914,737

DATED : April 3, 1990

INVENTOR(S) : KOJI AMEMIYA ET AL.

It is certified that error appears in the above-identified patent and that said Letters Patent is hereby corrected as shown below:

COLUMN 2

Line 1, "polyethyelen" should read --polyethylene--.
Line 12, "transfer drum 5" should read --transfer drum 5,--.
Line 61, "toner," should read --toner--.
Line 64, "drum 5." should read --drum 1.--.

COLUMN 4

Line 18, "forming apparatus." should read --image forming apparatus.--.
Line 36, "diametr" should read --diameter--.

COLUMN 5

Line 29, "pare)" should read --pere)--.
Line 31, "pare)," should read --pere),--.

COLUMN 6

Line 4, "away," should read --away--.
Line 16, "photosensitive drum 5." should read --photosensitive drum 1.--.

UNITED STATES PATENT AND TRADEMARK OFFICE

CERTIFICATE OF CORRECTION

PATENT NO. : 4,914,737

DATED : April 3, 1990

INVENTOR(S) : KOJI AMEMIYA ET AL.

It is certified that error appears in the above-identified patent and that said Letters Patent is hereby corrected as shown below:

COLUMN 8

Line 28, "foregoing" should read --foregoing,--.
Line 31, "ling" should read --trailing--.
Line 32, "ambient," should read --ambient--.

COLUMN 10

Line 45, "laten" should read --latent--.

Signed and Sealed this

Fifteenth Day of October, 1991

*Attest:*

HARRY F. MANBECK, JR.

*Attesting Officer*

*Commissioner of Patents and Trademarks*